US005743664A

United States Patent [19]

Small

[11] Patent Number: 5,743,664

[45] Date of Patent: Apr. 28, 1998

[54] THERMAL COLOR PRINTER ADAPTED TO DETECT END OF DYE DONOR WEB BY USE OF LIGHT BEAMS AND LIGHT REFLECTIVE SPINDLE

[75] Inventor: Jeffrey A. Small, Rochester, N.Y.

[73] Assignee: Eastman Kodak Company, Rochester, N.Y.

[21] Appl. No.: 795,265

[22] Filed: Feb. 10, 1997

[51] Int. Cl.[6] ..... B41J 35/36

[52] U.S. Cl. ..... 400/249; 400/240; 400/242

[58] Field of Search ..... 400/244, 225, 400/237, 240, 240.3, 240.4, 242, 247, 249

[56] References Cited

U.S. PATENT DOCUMENTS

| | | | |
|---|---|---|---|
| 4,612,446 | 9/1986 | Suzuki | 400/249 |
| 4,620,184 | 10/1986 | Nedstedt | 340/675 |
| 4,710,781 | 12/1987 | Stephenson | 346/76 PH |
| 4,790,677 | 12/1988 | Kress | 400/249 |
| 4,947,472 | 8/1990 | Maeda | 355/72 |
| 5,024,394 | 6/1991 | Ozawa et al. | 242/198 |
| 5,047,652 | 9/1991 | Lisnyansky et al. | 250/571 |
| 5,233,408 | 8/1993 | Satula | 356/402 |
| 5,280,274 | 1/1994 | Uemura et al. | 340/675 |
| 5,280,303 | 1/1994 | Maslanka | 346/76 PH |
| 5,344,244 | 9/1994 | Fukahori et al. | 400/249 |
| 5,393,149 | 2/1995 | Iima | 400/208 |
| 5,399,031 | 3/1995 | Whritenor | 400/120.04 |
| 5,466,075 | 11/1995 | Kouzai et al. | 400/240.3 |
| 5,549,400 | 8/1996 | Tang et al. | 400/236 |

*Primary Examiner*—Edgar S. Burr
*Assistant Examiner*—Steven S. Kelley
*Attorney, Agent, or Firm*—Walter S. Stevens

[57] ABSTRACT

Thermal printer adapted to detect end of dye donor web by use of light beams. The printer includes a dye donor web supply spindle having a light-reflecting surface thereon. A dye donor web is wound about the spindle, the dye donor web having a predetermined number of substantially transparent color patches therein. A light source disposed near the dye donor web emits an incident light beam containing a predetermined first color penetrating the dye donor web. A portion of the incident light beam that is unabsorbed by the color patches passes through the patches of the dye donor web and is intercepted by the light reflecting surface which reflects the incident light beam. The reflected light defines a reflected light beam that passes through the dye donor web on its way to a detector disposed near the dye donor web. The detector detects the reflected light beam. The reflected light beam received by the detector indicates whether the minimum number of color patches required to produce a full-color image remains on the supply spindle. Operation of the printer is aborted when the detector detects less than the minimum number of color patches to produce a full-color image. In this manner, receiver medium is not wasted and damage to the printer and its print head are avoided.

12 Claims, 2 Drawing Sheets

THERMAL COLOR PRINTER ADAPTED TO DETECT END OF DYE DONOR WEB BY USE OF LIGHT BEAMS AND LIGHT REFLECTIVE SPINDLE

BACKGROUND OF THE INVENTION

1. Technical Field

The present invention relates generally to dye transfer thermal color printers, and, more particularly, to a thermal color printer adapted to detect the end of a dye donor web by use of light beams, so that the printer stops printing as the end of the dye donor web is detected in order to reduce waste and preclude damage to the printer.

2. Background Art

In a dye transfer color thermal printer, the finished print is made by successively transferring yellow, magenta, and cyan dyes from respective dye frames or patches of a dye donor web onto a dye receiver medium. In one type of color thermal printer, such as disclosed in commonly assigned U.S. Pat. No. 4,710,781, which issued to Stanley W. Stephenson on Dec. 1, 1987, a dye donor web contains a repeating series of frames of differently colored, heat transferable dyes. The dye donor web is disposed between a receiver medium, such as coated paper, and a print head formed of a plurality of individual resistive heating elements. When a particular heating element is energized, its heat causes dye from the donor web to transfer to the receiver medium.

Conventionally, a yellow frame is first positioned under the print head with the receiver medium. As the yellow frame and receiver medium are advanced, the heating elements are selectively energized to form a yellow dye image on the receiver medium. Next, a magenta frame and the receiver medium are moved under the print head. Both the receiver medium and the magenta frame are moved as the heating elements are selectively energized, whereby a magenta dye image is formed, superimposed upon the yellow image. This process is repeated for remaining frames of the series, such that a multi-color image is formed on the receiver medium. However, thermal color printers may be damaged if the printer attempts to print after the end of the dye donor web is reached.

In this regard, the dye donor web is typically attached to its supply spool by means of an adhesive. If the end of the dye donor web becomes detached from its supply spool, the printer mechanism may pull the end of the dye donor web through the print head, together with fragments of the adhesive. The print head then becomes contaminated with the adhesive thereby causing the print head to be repaired or replaced. This is a highly undesirable result because repair or replacement of the print head increases printing costs. Therefore, a problem in the art is pulling the end of the dye donor web after the end of the dye donor web is reached, such that adhesive fragments attached to the end of the dye donor web contact the print head.

However, it may be the case that the dye donor is so firmly attached to its supply spool that the dye donor web cannot be detached from the supply spool. The dye donor web will therefore become stalled in the printer. In this case, the printer will continue to try to pull the stalled dye donor web past the print head thereby exerting excessive force on the printer's gear train. Such an excessive force exerted on the printer's gear train may damage the gear train which in turn may necessitate repair or replacement of the gear train. Repair or replacement of the gear train increases printing costs. Therefore, another problem in the art is printing after the end of the dye donor web is reached, such that excessive force is exerted on the gear train.

If the dye donor web becomes stalled because it is firmly attached to its supply spool, as discussed hereinabove, the print head may be further damaged if the heat of the thermal print head melts the stalled dye donor web. Therefore, yet another problem in the art is continued printing after the end of the dye donor web is reached, such that the stalled donor web melts.

In addition, the dye donor web normally affords protection to the print head by providing a slip layer between the print head and the receiver medium. However, if the dye donor web becomes separated from its supply spool and is pulled completely past the print head while the print head continues to conduct printing, the absence of the slip layer function, which is normally afforded by the dye donor web, exposes the print head to direct contact with the receiver medium. This is undesirable because direct contact between the print head and the receiver medium may damage the print head which may necessitate repair or replacement of the print head. Repair or replacement of the print head increases printing costs. Therefore, another problem in the art is printing after the end of the dye donor web is reached, such that contact between the print head and the receiver medium is avoided.

Of course, if a print job is started when there is insufficient dye on the dye donor web, then receiver medium is wasted because a full print can not be obtained. Therefore, still another problem in the art is printing after the end of the dye donor web is reached, such that receiver medium is wasted.

In addition, if a print job is started when there is insufficient dye on the dye donor web, time is wasted in making a defective print. Therefore, yet another problem in the art is the time wasted making defective prints.

Apparatus and methods for controlling the position of a dye donor web are known. One such apparatus and method is disclosed in commonly assigned U.S. Pat. No. 5,549,400 titled "High Precision Dye Donor Web Positioning In A Thermal Color Printer" and issued Aug. 27, 1996 in the name of Manh Tang, et al. This patent discloses a thermal printer that includes a web transport for positioning the dye donor web along a path, a sensor spaced from the print line for detecting the arrival of a leading edge of a dye frame, and a control for the web transport. The control repositions the dye donor web along the path so that the leading edge of the dye frame is in alignment with the print line before printing begins. The web transport is bi-directional. That is, the web transport moves the dye donor web in the forward and reverse directions past the print line. More specifically, the sensor detects the leading edge of a frame while the donor web moves in the forward direction. The control stops the web and reverses it to rewind the web until the edge of the dye frame is in alignment with the print line. The control then adjusts the amount of repositioning of the dye donor web that is effected as a function of the detected leading edge's location along the dye donor web. While the Tang, et al. apparatus works well for its intended purpose, it requires two motors and associated gearing to achieve the aforementioned bi-directional movement of the web. One motor drives the supply spool and the other motor drives the take-up spool. Moreover, no mechanism is provided that directly and precisely detects the end of the dye donor web.

Therefore, what has long been needed is a thermal color printer adapted to detect the end of a dye donor web, so that the printer stops printing as the end of the dye donor web is detected in order to reduce waste and preclude damage to the printer.

DISCLOSURE OF THE INVENTION

The invention in its broad form resides in a printer, comprising a dye donor web having a plurality of color patches therein; and a detection system associated with the dye donor web for detecting when the dye donor web has less than a minimum number of the color patches.

An object of the present invention is to provide a thermal color printer adapted to reduce waste and preclude damage to the printer.

A feature of the present invention is the provision of a light source emitting an incident light beam containing a first color penetrating the dye donor web which surrounds a supply spool, the incident light beam passing through the dye donor web to be reflected from the surface of the supply spool so as to define a reflected light beam containing a second color.

Another feature of the present invention is the provision of a detector for detecting the second color contained in the reflected light beam.

Yet another feature of the present invention is the provision of a controller connected to the detector and associated with the dye donor web for controlling movement of the dye donor web in response to the second color detected by the detector.

An advantage of the present invention is that adhesive fragments attached to the end of the dye donor web are precluded from contacting the print head.

Another advantage of the present invention is that excessive force is not exerted on a gear train belonging to the printer.

Yet another advantage of the present invention is that melting of a stalled dye donor web is avoided.

Still another advantage of the present invention is that contact between the print head and the receiver medium is precluded to avoid damage to the print head.

A further advantage of the present invention is that receiver medium is not wasted.

Another advantage of the present invention is that time is not wasted making defective prints.

These and other objects, features and advantages of the present invention will become apparent to those skilled in the art upon a reading of the following detailed description when taken in conjunction with the drawings wherein there is shown and described illustrative embodiments of the invention.

BRIEF DESCRIPTION OF THE DRAWINGS

In the detailed description of the preferred embodiments of the invention presented hereinbelow, reference is made to the accompanying drawings, in which.

BEST MODE FOR CARRYING OUT THE INVENTION

Figure 1:
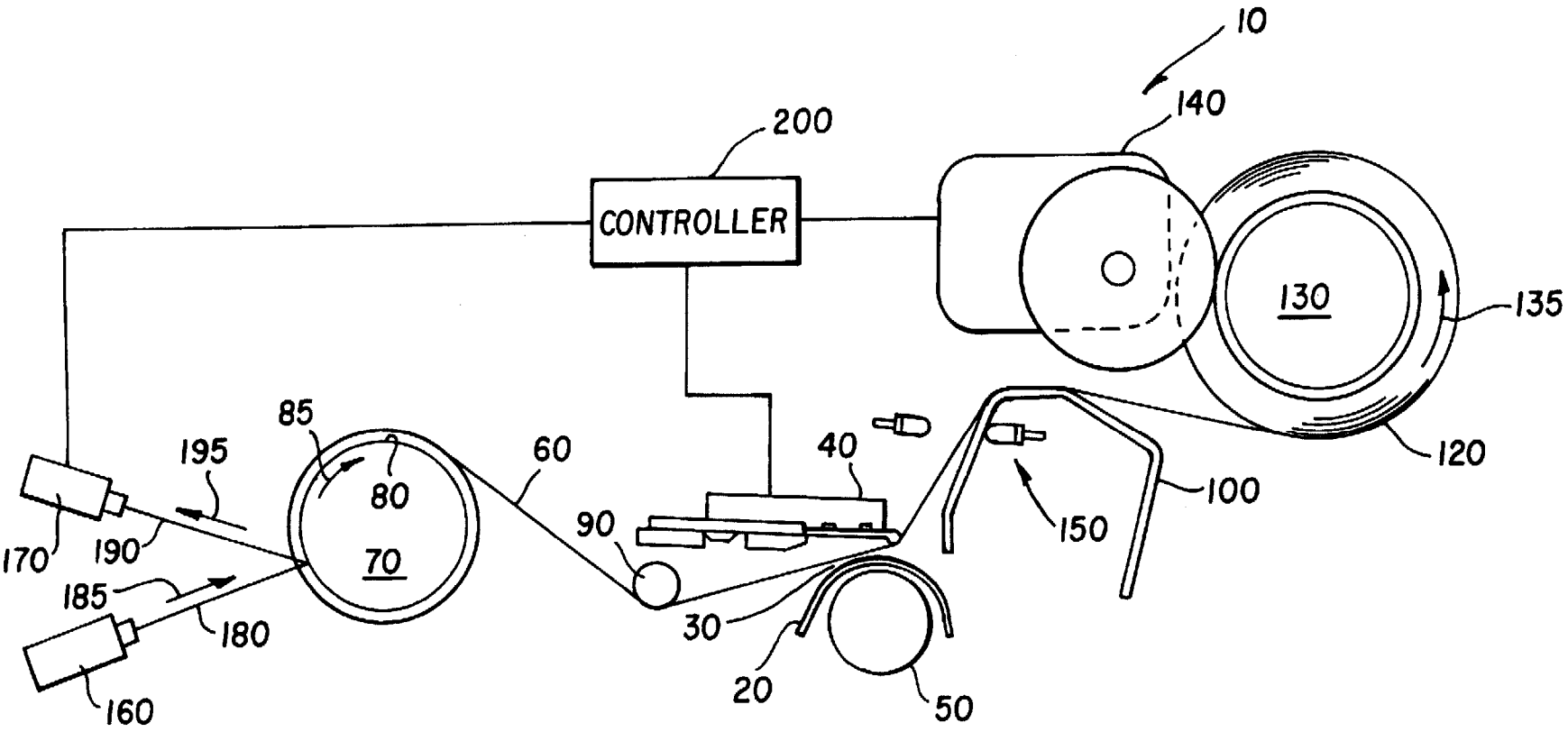
FIG. 1 is a view in elevation of a printer belonging to the invention.
Figure 2:
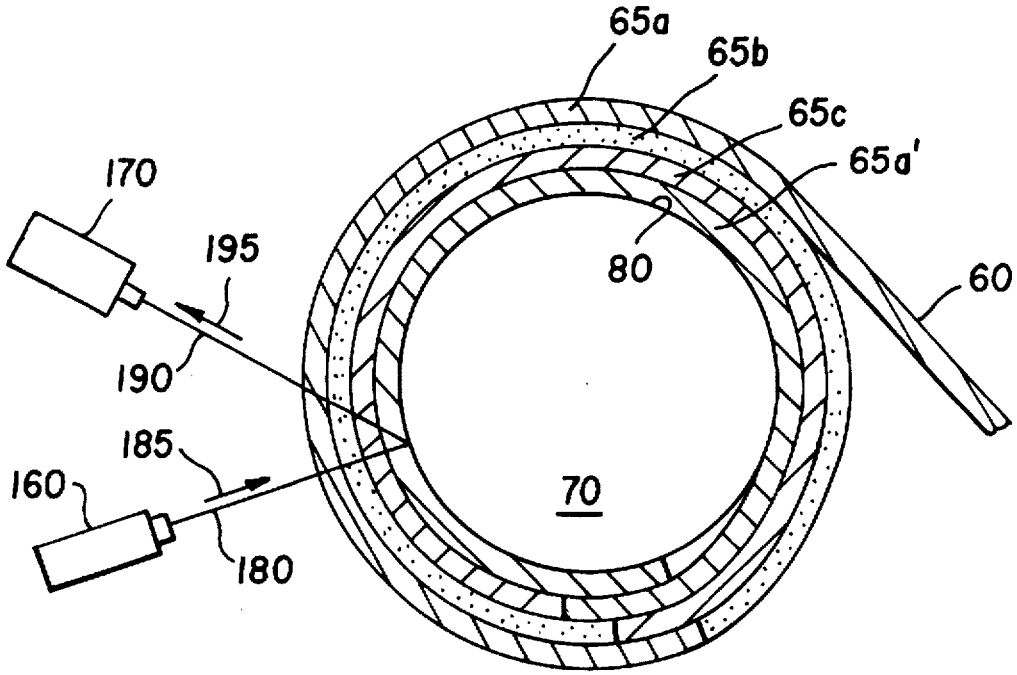
FIG. 2 is a view in elevation of a dye donor web wound about a supply spindle, the dye donor web having a plurality of color patches therein, this view also showing a light source and a light-sensitive detector disposed near the dye donor web.

Referring to FIGS. 1 and 2, there is shown a thermal printer, generally referred to as 10, for printing a color image on a dye receiver medium 20, which receiver medium 20 may be a sheet of coated paper or transparency material. A picker and guide assembly (not shown) urges receiver medium 20 into a nip area 30 defined between a print head 40 and a platen roller 50, which platen roller 50 is driven by a platen drive motor (not shown). Print head 40 is formed of a plurality of individual resistive heating elements (not shown). A supply roll of a dye donor ribbon or web 60 is wound about a generally cylindrical supply spool or spindle 70 which has a light-reflecting surface 80 thereon. Spindle 70 may rotate in a clockwise direction as illustrated by a curved arrow 85. For reasons disclosed more fully hereinbelow, surface 80 is preferably matted so that light is diffusely reflected from surface 80. Moreover, surface 80 is preferably of a color, such as white or yellow, capable of reflecting substantially all light incident upon it. Web 60 includes a repeating series of sequentially-arranged, substantially transparent, heat transferable dye patches or frames 65*a*, 65*b*, and 65*c*. In the illustrated embodiment of the invention, a patch 65*a*' is the last patch on spindle 70. In the embodiment disclosed herein, the sequential patches 65*a*/65*b*/65*c*/65*a*' have the colors yellow, magenta, cyan, and yellow, respectively.

Still referring to FIGS. 1 and 2, dye donor web 60 is trained about an idler roller 90, the previously mentioned print head 40, a web guide 100, and a take-up reel 120 mounted on a take-up spindle 130. In the illustrated embodiment of the invention, take-up spindle 130 is driven in a counter-clockwise direction (as illustrated by a curved arrow 135) by a take-up motor 140, in order to advance dye donor web 60 past the print line defined by print head 40. In addition, dye donor web 60 may also be advanced by platen roller 50, when platen roller 50, which is driven by the previously mentioned platen drive motor, engages receiver medium 20 as receiver medium 20 engages dye donor web 60. As used herein, the phrase "print line" is not intended to strictly define a single line of printing elements, as print heads are commonly constructed with staggered printing elements. Rather, the phrase "print line" is used herein to connote that the printing elements are arranged along one or more generally straight lines. During the printing process, dye donor web 60 is extended through nip 30 so that it is disposed between receiver medium 20 and print head 40. When a predetermined heater element is energized, the heat emanating from the heater element causes dye from donor web 60 to transfer to receiver medium 20.

Referring yet again to FIGS. 1 and 2, during the printing process it is desirable to properly position the dye donor web relative to the dye receiver medium. In order to properly position the dye donor web relative to the dye receiver medium, a color discrimination system, generally referred to as 150, is placed directly in the path of dye donor web 60 just past thermal print head 40 in the direction of travel of dye donor web 60. Color discrimination system 150 detects the presence of different color frames on dye donor web 60 as web 60 advances past the "print line". When color discrimination system 150 detects a new color frame during the printing cycle, the advancement of web 60 by means of motor 140 and the platen drive motor (not shown) is stopped to allow the specific color of the color frame to be printed on receiver medium 20. Color discrimination system 150 is more fully described in the aforementioned U.S. Pat. No. 4,710,781 issued to Stephenson, the disclosure of which is hereby incorporated by reference. The donor web and receiver medium positioning system is described in more detail in commonly assigned U.S. Patent No. 5,399,031 titled "Assisting Movement Of Dye Receiver Past Thermal Print Head" issued Mar. 21, 1995 in the name of James A Whritenor, the disclosure of which is hereby incorporated by reference.

Figure 3:
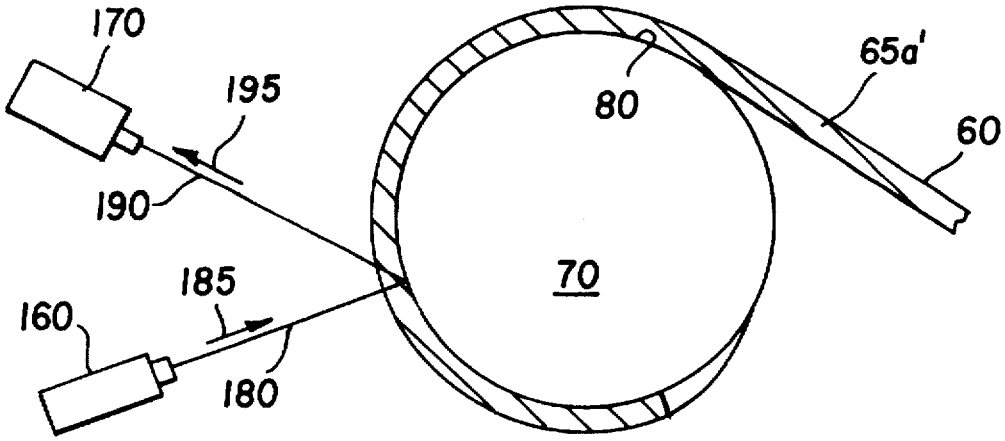
FIG. 3 is a view in elevation of a predetermined one of the color patches remaining wound on the supply spindle, this view also showing the light source and the light-sensitive detector disposed near the color patch.

As best seen in FIGS. 1 and 3, motor 140 rotates take-up spindle 130 in a counter-clockwise direction (as illustrated), so that web 60 is unwound from about supply spindle 70 during the printing process. However, after the last complete set of patches 65*a*/65*b*/65*c* are unwound from about supply spindle 70, an incomplete set of patches typically remains wound on supply spindle 70. In the case of the embodiment of the invention illustrated in FIG. 3, the remaining incomplete "set" of patches may be only the yellow patch 65*a*'. However, it is appreciated by the person of ordinary skill in the art to which the present invention pertains that the remaining incomplete set of patches may contain patches of any color. Also, the remaining incomplete set of patches may comprise any number of color patches as long as the number of patches is less than the minimum number of patches required to print a complete full-color image.

However, printing after the end of dye donor web 60 is reached may damage printer 10. First, if the end of dye donor web 60 becomes detached from supply spindle 70, motor 140 will pull the end of the dye donor web 60 through nip 30, together with fragments of any adhesive typically used to bond the end of web 60 to supply spindle 70. Print head 40 may then become contaminated with the adhesive if the adhesive fragments contact print head 40. Secondly, even if the end of web 60 does not become detached from supply spindle 70, motor 140 may continue to attempt to pull dye donor web 60 past print head 40. This causes dye donor web 60 to stall in printer 10, thereby exerting excessive force on a gear train (not shown) belonging to printer 10. Such an excessive force exerted on the gear train may damage the gear train. Also, even if the torque of motor 140 could be limited so as to prevent such damage, in a platen drive system where platen roller 50 is driven, platen roller 50 must be driven with substantial torque. If donor web 60 becomes stalled, the torque exerted by platen roller 50 may be excessive, causing the types of damage indicated hereinabove. Thirdly, if dye donor web 60 becomes stalled while thermal print head 40 continues to print, thermal print head 40 may be damaged if the heat of print head 40 melts the stalled dye donor web 60. Fourthly, if dye donor web 60 becomes separated from supply spindle 70 and is pulled completely past print head 40, the slip layer between print head 40 and receiver medium 20 normally afforded by dye donor web 60 is absent, thereby bringing print head 40 into direct contact with receiver medium 20. Direct contact between print head 40 and receiver medium 20 may damage print head 40. Finally, if a print job is started when there are an insufficient number of dye patches (e.g., 65*c*/65*a*') on dye donor web 60, then receiver medium 20 is wasted because a full print can not be produced. For all the foregoing reasons, it is highly desirable that printing be aborted when less than the minimum number of patches (i.e., 65*a*/65*b*/65*c*) for a complete full-color image remain on supply spool 70.

With particular reference to FIGS. 2 and 3, a light source 160 and a light-sensitive detector 170 cooperate to detect when less than the minimum number of patches 65*a*/65*b*/65*c* required for a complete full-color image remain on supply spool 70. More specifically, light source 160 is disposed near supply spindle 70 which has a supply roll of dye donor web 60 mounted thereon. Light source 160 emits an incident light beam of a predetermined first color which may penetrate through transparent dye donor web 60 along a first path 180 generally towards the center of supply spindle 70. The direction of path 180 is illustrated in the several figures by an arrow 185. If the incident light beam penetrates through dye donor web 60, the incident light beam is then intercepted by light reflecting surface 80, which belongs to supply spindle 70. Surface 80 thereafter reflects the light beam along a second path 190. The direction of light along path 190 is illustrated in the several figures by an arrow 195.

Again referring to FIGS. 2 and 3, the light-sensitive detector 170 is shown disposed near supply spindle 70 for detecting the light beam traveling along path 190. Light source 160 and detector 170 are positioned with respect to surface 80 such that detector 170 will detect diffused reflected light and will not detect "spectral light" (i.e., glare) reflected from surface 80 or reflected from any of the surfaces defined in donor web 60 when donor web 60 is wrapped around spool 70. "Spectral light" reflections or glare will occur if the angle of the incident light beam directed toward surface 80 along path 180 is equal to the angle of the light beam reflected from surface 80 along path 190. It is important that detector 170 not receive "spectral light" reflections because "spectral light" reflections will effectively "blind" detector 170 in the sense that detector 170 will no longer be able to differentiate between different colors reflected from surface 80. In addition, occurrence of "spectral light" reflections is caused solely by the angle of incidence being equal to the angle of reflection, as described hereinabove, and is independent of the number, as well as color, of patches (e.g., 65*c*/65*a*') on supply spindle 70. Therefore, detector 170 will not indicate whether or not less than the minimum number of color patches 65*a*/65*b*/65*c* remain on supply spindle 70 if detector 170 is subject to "spectral light" reflections.

Still referring to FIGS. 2 and 3, the color of the light beam is filtered or altered by any layers of the substantially transparent color patches (e.g., 65*c*/65*a*') which surround supply spindle 70 as the light beam travels toward surface 80 along path 180. It is this filtered or altered light beam 180 that finally intercepts and illuminates surface 80. More specifically, the various color patches (e.g., 65*c*/65*a*') of dye donor web 60 absorb associated wavelengths of the incident light beam. Any unabsorbed portion of the incident light beam reaches, and is reflected by, surface 80. Thus, color is not specifically detected by detector 170; rather, merely the existence of the reflected light beam is detected. Moreover, surface 80 is preferably white or of a color which readily reflects the filtered light beam back through the layers of substantially transparent color patches (e.g., 65*c*/65*a*') remaining on supply spindle 70.

It is appreciated from the description hereinabove, that in order to determine whether or not less than the minimum number of patches remain on spindle 70, detector 170 need only detect the existence of the reflected light beam. That is, the reflected light beam will only exist if less than all of the incident light beam is absorbed by patches on spindle 70. Less than all of the incident light beam is absorbed only when less than a complete set of patches remain on spindle 70.

Referring yet again to FIGS. 2 and 3, the light reflected from surface 80 travels along path 190 in direction 195 to be intercepted by detector 170. In the event at least the minimum number of patches (i.e., patches 65*a*/65*b*/65*c*) required to produce at least one full-color print remain on supply spindle 70, substantially all of the colors will be filtered-out by the layers of dye donor web 60 before the incident light beam is intercepted by surface 80. In this instance, detector 170 will not detect any light reflected from surface 80 because substantially all of the colors are filtered-out. On the other hand, in the event the minimum number of patches 65a/65b/65c required to produce at least one full-color print do not remain on supply spindle 70, less than all of the colors will be filtered-out by the layers of dye donor 60 as the incident light beam is intercepted by surface 80. Detector 170 is adapted to detect when less than all of the colors are filtered-out by the layers of dye donor web 60. In this case, the reflected light beam will contain one or more specific colors and be reflected to detector 170. Thus, the combination of the spatial arrangement of light source 160 and detector 170 with respect to surface 80, and the color selected for surface 80 are used in such a manner that detector 170 will generate a signal when less than the minimum number of patches remain on supply spindle 70. By way of example only and not by way of limitation, the colors in the reflected light beam detectable by detector 170 given the colors in the incident light beam emitted by light source 160 are summarized in the TABLE immediately hereinbelow.

TABLE

Colors Detectable By Detector 170 Given The Colors Emitted By Light Source 160

| Incident Light Beam Emitted By Light Source 160 | Color Patches Remaining On Supply Spindle 70 | Colors Filtered-Out Of Incident Light Beam By Color Patches Remaining On Spindle 70 | Colors Reflected From Surface 80 And Detected By Detector 190 (i.e., colors intercepted by surface 80) |
|---|---|---|---|
| Red, Green, Blue | 65a' (yellow) | Blue | Red, Green |
| Red, Green, Blue | 65b (magenta) | Green | Red, Blue |
| Red, Green, Blue | 65c (cyan) | Red | Green, Blue |
| Red, Green, Blue | 65b (magenta) | Green | None (i.e., no |
| | 65c (cyan) | Red | light reflected. |
| | 65a' (yellow) | Blue | Therefore, no light detected.) |
| Red, Green, Blue | 65b (magenta) | Green | Blue |
| | 65c (cyan) | Red | |
| Red, Green, Blue | 65b (magenta) | Green | Red |
| | 65a' (yellow) | Blue | |
| Red, Green, Blue | 65c (cyan) | Red | Green |
| | 65a' (yellow) | Blue | |

Returning to FIG. 1, there is shown a controller 200, which in the preferred embodiment, interconnects detector 170, the platen drive motor (not shown) and motor 140 for operating the platen drive motor and motor 140 in response to the second color detected by detector 170. In this regard, detector 170 is selected so that it generates an output signal in response to the second color detected by detector 170. The detector signal is received by controller 200, which generates an output signal that is received by motor 140 and the platen drive motor. Operation of the platen drive motor and motor 140 is interrupted or stops when they receive the controller signal, so that the platen drive motor and motor 140 stop unwinding dye donor web 60 from supply spindle 70. When motor 140 stops unwinding dye donor web 60 from supply spindle 70, dye donor web 60 simultaneously stalls (i.e., stops advancing past print head 40). In addition, controller 200 may be connected to print head 40 for turning-off the heaters belonging to print head 40, so that the heaters do not melt that portion of dye donor web 60 stalled adjacent the heaters.

It is appreciated from the teachings herein, that an advantage of the present invention is that adhesive fragments attached to the end of dye donor web 60 are precluded from contacting print head 40. This is so because the invention detects when the end portion of dye donor web 60 is reached and stops the platen drive motor and motor 140 which in turn stop unwinding web 60 from about supply spindle 70. That is, the end portion of web 60, and the adhesive securing the end portion to supply spindle 70, can not become detached from supply spindle 70 and travel to print head 40. In this fashion, adhesive fragments can not contaminate or damage print head 40.

Another advantage of the present invention is that excessive force is not exerted on the gear train belonging to the printer. This is so because the invention detects when the end portion of dye donor web 60 is reached and stops the platen drive motor and motor 140, which in turn stops unwinding web 60 from about supply spindle 70. If the platen drive motor and motor 140 where to attempt to continue unwinding web 60 from supply spindle 70, excessive force would be exerted on the printer's gear train, possibly damaging the gear train.

Yet another advantage of the present invention is that melting of a stalled donor web is avoided. This is so because detector 170 detects when the end portion of dye donor web 60 is reached and alerts controller 200, which in turn turns-off the heaters belonging to print head 40.

Still another advantage of the present invention is that contact between print head 40 and receiver medium 20 is precluded in order to avoid damage to print head 40. This is so because the invention detects when the end portion of dye donor web 60 is reached and stops the platen drive motor and motor 140 which in turn stop unwinding web 60 from about supply spindle 70. Thus, the end portion of web 60 that is attached to supply spindle 70 can not become detached from supply spindle 70 and travel through nip 30. In this manner, a portion of web 60 will remain in nip 30, so that print head 40 can not make direct contact with dye receiver medium 20.

A further advantage of the present invention is that receiver medium 20 is not wasted when less than the minimum number of patches 65a/65b/65c remain on supply spindle 70. This is so because the invention detects when less than the minimum number of dye patches to produce a complete full-color image remain on supply spindle 70. When less than the minimum number of dye patches remain on supply spindle 70, operation of the platen drive motor and motor 140 is interrupted so that web 60 stops unwinding from supply spindle 70.

Another advantage of the present invention is that time is not wasted making defective prints. This is so because the invention detects the condition where less than the minimum number of dye patches remain on supply spindle 70. Attempting to print when less than the minimum number of patches are present results in a defective print and therefore wastes the time spent in making the defective print.

While the invention has been described with particular reference to a preferred embodiment, it will be understood by those skilled in the art that various changes may be made and equivalents may be substituted for elements of the preferred embodiment without departing from the invention. In addition, many modifications may be made to adapt a particular situation and material to a teaching of the invention without departing from the essential teachings of the present invention. For example, the invention is described with reference to detecting when an incomplete set of dye patches remain on a supply spindle belonging to a thermal color printer; however, the invention can be used to detect the end portion of any similar media by detecting the distinctive color of the end portion, as long as the color of the end portion is different from the color of the other portions of the media.

Therefore, what is provided is a thermal color printer adapted to detect the end of a dye donor web by use of light beams, so that the printer stops printing as the end of the dye donor web is detected in order to reduce waste and preclude damage to the printer.

The invention has been described in detail with particular reference to preferred embodiments thereof, but it will be understood that variations and modifications can be effected within the spirit and scope of the invention.

Parts List

10 . . . thermal printer
20 . . . receiver medium
30 . . . nip area
40 . . . print head
50 . . . platen roller
60 . . . dye
65*a*/65*b*/65*c*/65*a*' . . . color patches
70 . . . supply spindle
80 . . . light-reflecting surface
90 . . . idler roller
100 . . . web guide
120 . . . take-up reel
130 . . . take-up spindle
140 . . . take-up motor
150 . . . color discrimination system
160 . . . light source
170 . . . light detector
180 . . . light beam path
185 . . . arrow
190 . . . second light beam path
195 . . . arrow
200 . . . controller

I claim:

1. A printer comprising:

(a) a spindle having a light-reflective surface thereon;

(b) a dye donor web wound about said spindle, said dye donor web having a predetermined number of non-opaque color patches therein, each color patch being adapted to absorb at least one different one of a plurality of colors;

(c) a light source disposed near said dye donor web for emitting an incident light beam containing said plurality of colors, and being incident upon said donor web in a direction toward the light-reflecting surface so as to be selectively absorbed by the color patches, whereby any unabsorbed portion of the incident light beam reaches the light-reflecting surface and is reflected thereby so as to define a reflected light beam; and (d) a detector associated with said dye donor web and adapted to detect a characteristic of the reflected light beam, the characteristic being indicative of when the dye donor web has less than a minimum number of the color patches.

2. The printer according to claim 1, wherein the characteristic of the reflected light beam detected by said detector is the existence of the reflected light beam.

3. A printer, comprising:

(a) a spindle having a light-reflecting surface thereon;

(b) a dye donor web wound about said spindle, said dye donor web having a predetermined number of substantially transparent color patches therein, each color patch being adapted to absorb at least one different one of a plurality of colors;

(c) a light source disposed near said dye donor web for emitting a light beam containing said plurality of colors and being incident upon said dye donor web in a direction toward the light-reflecting surface so as to be selectively absorbed by the color patches, any unabsorbed portion of the light beam reaching the light-reflecting surface being reflected thereby so as to define a reflected light beam; and (d) a detector disposed near said donor web, said detector adapted to detect the reflected light beam, the reflected light beam being indicative of when the dye donor web has less than a minimum number of the color patches.

4. The printer of claim 3, further comprising a motor operatively engaging said dye donor web for unwinding said dye donor web from about said spindle.

5. The printer of claim 4, further comprising a controller interconnecting said detector and said motor for operating said motor in response to the reflected light beam detected by said detector.

6. A printer, comprising:

(a) a print head having at least one heater element therein;

(b) a spindle spaced-apart from said print head, said spindle having a light-reflecting surface thereon;

(c) a dye donor web wound about said spindle, said dye donor web having a predetermined minimum number of sequentially-arranged substantially transparent color patches therein, a portion of said dye donor web extending adjacent to said print head;

(d) a light source disposed near said dye donor web for emitting an incident light beam containing a predetermined first color penetrating said dye donor web along a first path intercepted by the light-reflecting surface, the light beam being reflected by the light-reflecting surface so as to define a reflected light beam containing a predetermined second color associated with less than the minimum number of predetermined color patches, the reflected light beam penetrating said dye donor web along a second path;

(e) a motor operatively engaging said dye donor web for unwinding said dye donor web from about said spindle, so that said dye donor web advances past the print head as said motor operates; and (f) a detector disposed near said dye donor web and intercepting the reflected light beam for detecting the second color, said detector connected to said motor for interrupting the operation of said motor as said detector detects the second color, whereby said motor stops unwinding said dye donor web from about said spindle as the operation of said motor is interrupted, and whereby said dye donor web stops advancing past the print head as said dye donor web stops unwinding from about said spindle.

7. The printer of claim 6, further comprising a controller interconnecting said detector and said motor for operating said motor in response to the second color detected by said detector.

8. The printer of claim 7, wherein said controller interconnects said detector and said print head for operating the heater element of the print head in response to the second color detected by said detector.

9. In a printer, a method of detecting color of a medium permeable to light, comprising the steps of:

(a) mounting the medium on a light-reflecting surface;

(b) providing a light source capable of emitting an incident light beam toward the medium, the incident light beam containing a first color, at least a portion of the first color being absorbed by the medium so that an unabsorbed portion of the incident light beam penetrates through the medium and intercepts the light-reflecting surface to be reflected therefrom, the reflected light beam containing a second color; and (c) providing a detector disposed to intercept the reflected light beam for detecting the second color contained in the reflected light beam, the second color being indicative of the color of the medium and when the dye donor web has less than a minimum number of the color patches.

10. In a printer, a method of detecting the color of an end portion of a substantially transparent dye donor web, comprising the steps of:

(a) providing a dye donor web wrapped about a spindle having a light-reflecting surface thereon;

(b) providing a light source capable of emitting an incident light beam toward the surface, the incident light beam containing a first color, at least a portion of the first color being absorbed by the dye donor web so that an unabsorbed portion of the incident light beam penetrates through the dye donor web and intercepts the light-reflecting surface to be reflected therefrom, the reflected light beam containing a second color; and (c) providing a detector disposed to intercept the reflected light beam for detecting the second color contained in the reflected light beam, the second color being indicative of the color of the end portion of the dye donor web and when the dye donor web has less than a minimum number of the color patches.

11. The method of claim 10, further comprising the step of providing a motor engaging the dye donor web for unwrapping the dye donor web from about the spindle.

12. The method of claim 11, further comprising the step of providing a controller interconnecting the detector and the motor for operating the motor in response to the second color detected by the detector.

* * * * *